United States Patent [19]

Iwaki

[11] Patent Number: 4,691,675

[45] Date of Patent: Sep. 8, 1987

[54] IDLING SPEED CONTROL SYSTEMS FOR INTERNAL COMBUSTION ENGINES

[75] Inventor: Masato Iwaki, Higashihiroshima, Japan

[73] Assignee: Mazda Motor Corp., Japan

[21] Appl. No.: 882,722

[22] Filed: Jul. 7, 1986

[30] Foreign Application Priority Data

Jul. 11, 1985 [JP] Japan ..... 60-153462

[51] Int. Cl.[4] ..... F02D 41/16

[52] U.S. Cl. ..... 123/339; 123/352

[58] Field of Search ..... 123/339, 352, 585

[56] References Cited

U.S. PATENT DOCUMENTS 4,237,838 12/1980 Kinugawa et al. ..... 123/339

4,611,560 9/1986 Miyazaki et al. ..... 123/339

FOREIGN PATENT DOCUMENTS 58-53653 3/1983 Japan .

59-185853 10/1984 Japan ..... 123/339

*Primary Examiner*—Andrew M. Dolinar

*Attorney, Agent, or Firm*—Gerald J. Ferguson, Jr.; Michael P. Hoffman; Ronni S. Malamud

[57] ABSTRACT

An idling speed control system for an internal combustion engine comprises an engine speed sensor, a target idling speed determining unit for setting a target idling speed, an intake air mass flow determining unit for obtaining a difference between an actual idling speed detected by the engine speed sensor and the target idling speed and producing a control signal for determining intake air mass flow supplied to a combustion chamber on the strength of the difference obtained, an intake air mass flow adjusting unit for adjusting intake air mass flow supplied actually to the combustion chamber in response to the control signal, and an extra intake air supplying unit operative to cause the intake air mass flow adjusting unit to start supplying the combustion chamber with extra intake air mass flow when the actual idling speed has gone down to be lower than a first predetermined speed and then to cause the intake air mass flow adjusting unit to cease supplying with the extra intake air mass flow when the actual idling speed has risen to attain a second predetermined speed higher than the first predetermined speed.

14 Claims, 7 Drawing Figures

IDLING SPEED CONTROL SYSTEMS FOR INTERNAL COMBUSTION ENGINES

BACKGROUND OF THE INVENTION

1. Field of the Invention

The present invention relates generally to idling speed control systems for internal combustion engines, and more particularly, to a system for controlling idling speed of an internal combustion engine, in which extra intake air supplying means is provided for supplying temporarily with extra intake air of a predetermined volume to a combustion chamber of engine when the idling speed goes down to be lower than a predetermined relatively low speed.

2. Description of the Prior Art

There has been proposed an internal combustion engine used for an automobile equipped with an idling speed control system by which a feedback control is carried out for controlling intake air mass flow in an intake passage of the engine to keep idling speed of the engine at a predetermined target idling speed, so as to improve fuel consumption and advancing purification of exhaust gas of the engine. In such an idling speed control system, in order to avoid hunting phenomenon in control which may be caused when the control sensitivity is so increased as to provide the responsiveness unnecessarily quick, a so-called integration control in which a ratio of a variation in the intake air mass flow to a difference between an actual idling speed of the engine and the target idling speed, that is, a control gain is set to be relatively small is generally carried out. However, in the integration control performed with the small control gain, there is a problem that the intake air mass flow can not be sufficiently increased due to the slow responsiveness and therefore the engine is likely to stop operating when the engine is burdened with a relatively heavy load and thereby the idling speed thereof is suddenly lowered.

For the purpose of solving the above mentioned problem inherent in the integration control, there has been also proposed such an idling speed control system as disclosed in, for example, the Japanese patent application publishied before examination under the publication No. 58/53653. In this previously proposed system, when an actual idling speed of an engine has gone down to be lower than a predetermined low speed limit which is set to be lower enough than a target idling speed, intake air of relatively large volume is supplied to a combustion chamber of the engine as extra intake air determined apart from intake air supplied under such a feedback control as mentioned above and thereby the actual idling speed is caused to rise rapidly to exceed the low speed limit. With this repid rising of the actual idling speed, it is optimistically expected that the engine is prevented from allowing the idling speed thereof to be extremely lowered with relatively heavy load and as a result prevented from coming to a stop in its operation.

However, in the previously proposed system, the control for supplying the extra intake air to the combustion chamber of the engine (hereinafter, referred to as extra air supplying control) is commenced when the actual idling speed of the engine has crossed the low speed limit from high to low and then terminated when the actual idling speed has crossed the low speed limit from low to high, and therefore the extra air supplying control once commenced is terminated when the actual idling speed has risen to be slightly higher than the low speed limit, no matter whether the actual idling speed has become high enough to a load imposed on the engine on that occasion or not. Accordingly, for example, in the case where, immediately after the termination of the extra air supplying control, the actual idling speed of the engine has gone down to be lower than the low speed limit again so that another extra air supplying control is required, the lowering of the actual idling speed starts at the speed slightly higher than the low speed limit and progresses rapidly and therefore it is feared that the engine comes to a stop in its operation though another extra air supplying control is commenced.

Further, in the case where the volume of the extra intake air supplied to the combustion chamber of the engine under the extra air supplying control is predetermined to be relatively large in consideration of the above circumstance, there is another problem that the actual idling speed of the engine is caused to make an undesirably sudden rise to be too high under the extra air supply control.

OBJECTS AND SUMMARY OF THE INVENTION

Accordingly, it is an object of the present invention to provide an idling speed control system for an internal combustion engine which avoids the aforementioned problems encountered with the prior art.

Another object of the present invention is to provide an idling speed control system for an internal combustion engine, in which an extra air supplying control is carried out in such a manner that the engine is surely prevented from coming to a stop in its operation after the idling speed of the engine has gone down to be lower than a predetermined relatively low speed.

A further object of the present invention is to provide an idling speed control system for an internal combustion engine, in which an extra air supplying control is commenced so as to prevent the engine from coming to a stop in its operation when the idling speed of the engine has gone down to be lower than a first predetermined speed relatively low and then terminated when the idling speed has risen to attain a second predetermined speed higher than the first predetermined speed.

According to the present invention, there is provided an idling speed control system for an internal combustion engine, which comprises an engine speed sensor for detecting speed of an engine to which the system is applied, a target idling speed determining unit for setting a target idling speed, an intake air mass flow determining unit for obtaining a difference between an actual idling speed of the engine detected by the engine speed sensor and the target idling speed and producing a control signal for determining intake air mass flow supplied to a combustion chamber of the engine on the strength of the difference obtained, an intake air mass flow adjusting unit for adjusting ordinarily intake air mass flow supplied actually to the combustion chamber of the engine in response to the control signal produced by the intake air mass flow determining unit, and an extra intake air supplying unit operative to cause the intake air mass flow adjusting unit to start supplying the combustion chamber with extra intake air mass flow determined apart from the intake air mass flow determined in response to the control signal produced by the intake air mass flow determining unit when the actual idling speed of the engine has gone down to be lower than a first predetermined speed and then to cause the intake air mass flow adjusting unit to cease supplying with the extra intake air mass flow when the actual idling speed of the engine has risen to attain a second predetermined speed higher than the first predetermined speed.

In the idling speed control system thus constituted in accordance with the present invention, an extra air supplying control is performed during a period in which the intake air mass flow adjusting unit is caused to supplying with the extra intake air mass flow to the combustion chamber of the engine. Accordingly, the extra air supplying control is commenced when the actual idling speed of the engine has gone down to be lower than the first predetermined speed and then terminated when the actual idling speed of the engine has risen to exceed the first predetermined speed and further attain the second predetermined speed which is set to be higher than the first predetermined speed. That is, the extra air supplying control once cmmenced is not terminated when the actual idling speed of the engine has risen to be slightly higher than the first predetermined speed but terminated when the actual idling speed of the engine has risen to be so high as to attain the second predetermined speed. The second predetermined speed is to be set in an idling speed range with which the engine is able to keep a stable idle operation under a feedback control for the intake air mass flow carried out with a relatively small control gain.

Consequently, the engine equipped with the idling speed control system according to the present invention, in which the extra air supply control is performed with the second predetermined speed set as mentioned above, can be surely prevented from coming to a stop in its operation when the engine is burdened with a relatively heavy load in its idle operation and thereby the idling speed thereof is rapidly lowered. Further, it is not feared that the idling speed of the engine makes an undesirably sudden rise to be too high under the extra air supply control.

The above, and other objects, features and advantages of the present invention will become apparent from the following detailed description which is to be read in conjunction with the accompanying drawings.

DESCRIPTION OF THE PREFERRED EMBODIMENTS

Figure 1:
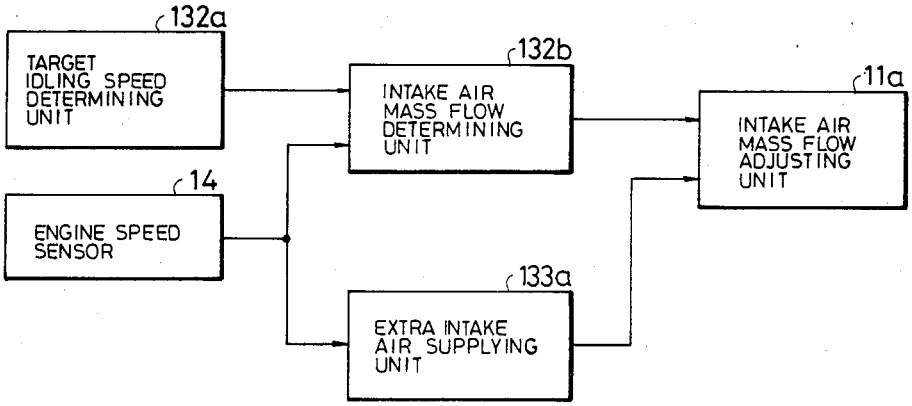
FIG. 1 is a block diagram illustrating the basic arrangement of an idling speed control system for an internal combustion engine according to the present invention.

FIG. 1 illustrates a functional block diagram of a system incorporating the present invention. In the functional block diagram of FIG. 1, the system comprises an engine speed sensor 14, a target idling speed determining unit 132*a*, an intake air mass flow determining unit 132*b*, an intake air mass flow adjusting unit 11*a*, and an extra intake air supplying unit 133*a*. The engine speed sensor 14 detects the speed of an engine to which the system is applied, and the target idling speed determining unit 132*a* is operative to set a target idling speed at which an actual idling speed of the engine is to be kept normally. The intake air mass flow determining unit 132*b* is operative to obtain a difference between the actual idling speed of the engine detected by the engine speed sensor 14 and the target idling speed set by the target idling speed determining unit 132*a*, and then to produce a control signal for determining intake air mass flow supplied to a combustion chamber of the engine on the strength of the difference obtained. The intake air mass flow adjusting unit 11*a* is operative ordinarily to adjust intake air mass flow supplied actually to the combustion chamber of the engine in response to the control signal produced by the intake air mass flow determining unit 132*b*. The extra intake air supplying unit 133*a* is operative to cause the intake air mass flow adjusting unit 11*a* to start supplying the combustion chamber with extra intake air determined apart from the intake air mass flow determined in response to the control signal produced by the intake air mass flow determining unit 132*b* when the actual idling speed of the engine detected by the engine speed sensor 14 has gone down to be lower than a first predetermined speed and then to cause the intake air mass flow adjusting unit 11*a* to cease supplying with the extra intake air when the actual idling speed of the engine has risen to attain a second predetermined speed higher than the first predetermined speed.

Figure 2:
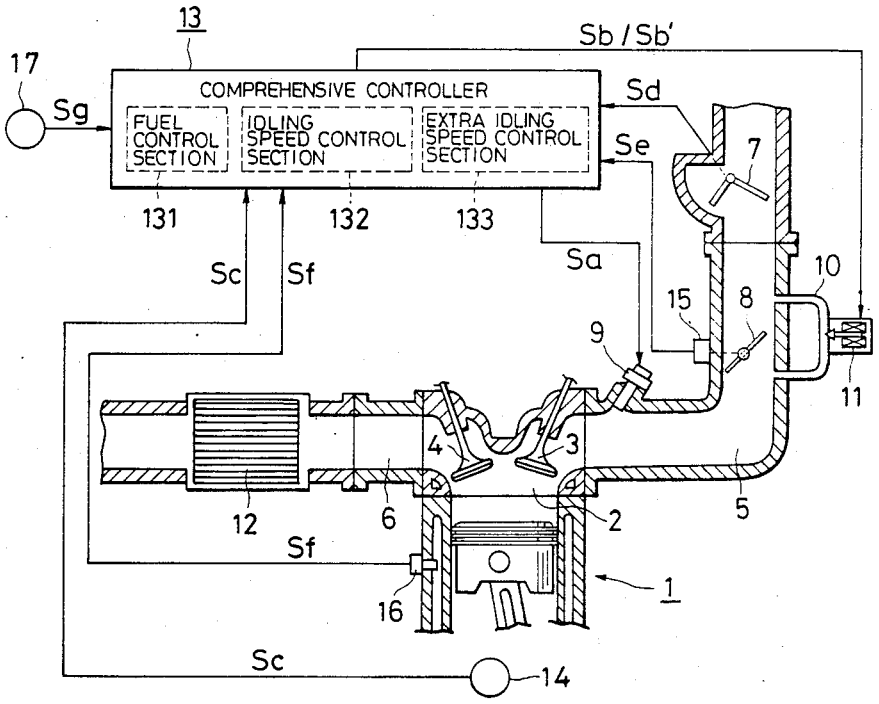
FIG. 2 is a schematic illustration showing one embodiment of idling speed control system for an internal combustion engine according to the present invention, together with an essential part of an engine to which the embodiment is applied.

FIG. 2 illustrates one embodiment of idling speed control system in accordance with the present invention, together with an essential part of an engine to which the embodiment is applied.

Referring to FIG. 2, an internal combustion engine 1 is provided with a combustion chamber 2 formed therein, and an inlet passage 5 connected through an intake valve 3 to the combustion chamber 2 and an exhaust passage 6 elongated through an exhaust valve 4 from the combustion chamber 2 are provided to the engine 1. In the inlet passage 5, an air flow meter 7, a throttle valve 8 and a fuel injector 9 are disposed from the upper course to the lower course thereof, and in the exhaust passage 6, a catalyst converter 12 is disposed for eliminating harmful components from exhaust gas discharged from the combustion chamber 2.

Further, a bypass passage 10 used for adjusting idling speed of the engine 1 is provided to the inlet passage 5 to detour the throttle valve 8 disposed in the inlet passage 5, and on the bypass passage 10, an electromagnetic control valve 11 is provided for adjusting, in response to its opening duty ratio, intake air mass flow supplied through the bypass passage 10 and the intake valve 3 to the combustion chamber 2. The opening duty ratio of the electromagnetic control valve 11 is controlled by a comprehensive controller 13.

The comprehensive controller 13 contains a fuel control section 131 which supplies an injection control signal Sa to the fuel injector 9 so as to control the quantity of fuel injected into the inlet passage 5 by the fuel injector 9, an idling speed control section 132 which supplies the electromagtnetic control valve 11 with a control pulse signal Sb having its pulse duration set variably in an idle operation of the engine 1 so as to control the idling speed of the engine 1 through adjustment of the intake air mass flow in the bypass passage 10 by the electromagnetic control valve 11, and an extra idling speed control section 133 which supplies the electromagnetic control valve 11 with an extra control pulse signal Sb' so as to cause the electromagtnetic control valve 11 to have a predetermined operation when the idling speed of the engine 1 has gone down to be lower than a predetermined low speed limit. The fuel control section 131 is supplied with a detection output signal Sc obtained from an engine speed sensor 14 to represent an actual engine speed and a detection output signal Sd obtained from the air flow meter 7 to represent intake air mass flow introduced into the inlet passage 5, and operative to produce the injection control signal Sa in response to the detection output signals Sc and Sd, for example, in such a manner than the fuel injector 9 is controlled with the injection control signal Sa so as to cause a fuel mixture supplied to the combustion chamber 2 to have the stoichiometric air to fuel ratio.

The idling speed control section 132 is operative to check whether the engine 1 is in the idle operation or not on the strength of a detection output signal Se obtained from a throttle opening degree sensor 15 to representing opening degree of the throttle valve 8 and the detection output signal Sc from the engine speed sensor 14. Then, the idling speed control section 132 is operative further to set a target idling speed at which an actual idling speed of the engine 1 is to be kept normally on the strength of a detection output signal Sf obtained from a coolant temperature sensor 16 to represent coolant temperature of the engine 1, a detection output signal Sg obtained from a load sensor 17 which detects a condition in which an appendant load such as an air conditioner is driven by the engine 1 and the detection output signal Sc from the engine speed sensor 14, so as to obtain a difference between the actual idling speed of the engine 1 and the target idling speed, and to produce, on the strength of the difference obtained and through integrating operation, the control pulse signal Sb having its pulse duration provided for determining intake air mass flow which is to be supplied to the combustion chamber 2 of the engine 1 for keeping the actual idling speed of the engine 1 at the target idling speed and supply the same to the electromagnetic control valve 11 when the engine 1 is in the idle operation.

The extra idling speed control section 133 is operative to detect, on the strength of the detection output signal Sc from the engine speed sensor 14, the fact that the actual idling speed of the engine 1 has gone down to be lower than a first predetermined speed set to be lower enough than the target idling speed set in the idling speed control section 132, then to produce the extra control pulse signal Sb' having its pulse duration corresponding to extra intake air mass flow which is determined apart from the intake air mass flow determined in response to the pulse duration of the control pulse signal Sb produced in the idling speed control section 132 and supply the same to the electromagnetic control valve 11 when the fact that the actual idling speed of the engine 1 has gone down to be lower than the first predertermined speed is detected. In addition, the extra idling speed control section 133 is further operative to continue to supply the electromagnetic control valve 11 with the extra control pulse signal Sb' until the actual idling speed of the engine 1 has risen to attain a second predetermined speed set to be higher than the first predetermined speed.

The above mentioned operation control arrangement for the engine 1, which includes the electromagnetic control valve 11 provided to the bypass passage 10, the engine speed sensor 14 and the comprehensive controller 13, constitutes the embodiment of the idling speed control system according to the present invention, and the comprehensive controller 13 is operative to control the electromagnetic control valve 11, as described above, so that a feedback idling speed control for keeping the actual idling speed of the engine 1 at the target idling speed and an extra air supply control which is commenced when the actual idling speed of the engine 1 has gone down to be lower than the first predetermined speed and terminated when the actual idling speed of the engine 1 has risen to attain the second predetermined speed are performed, respectively.

The comprehensive controller 13 provided in the embodiment shown in FIG. 2 may be composed of a microcomputer. One example of an operation program of such a microcomputer for controlling the electromagnetic control valve 11 in such a manner that the feedback idling speed control and the extra air supply control are performed is carried out in accordance with a flow chart shown in FIG. 3.

Figure 3:
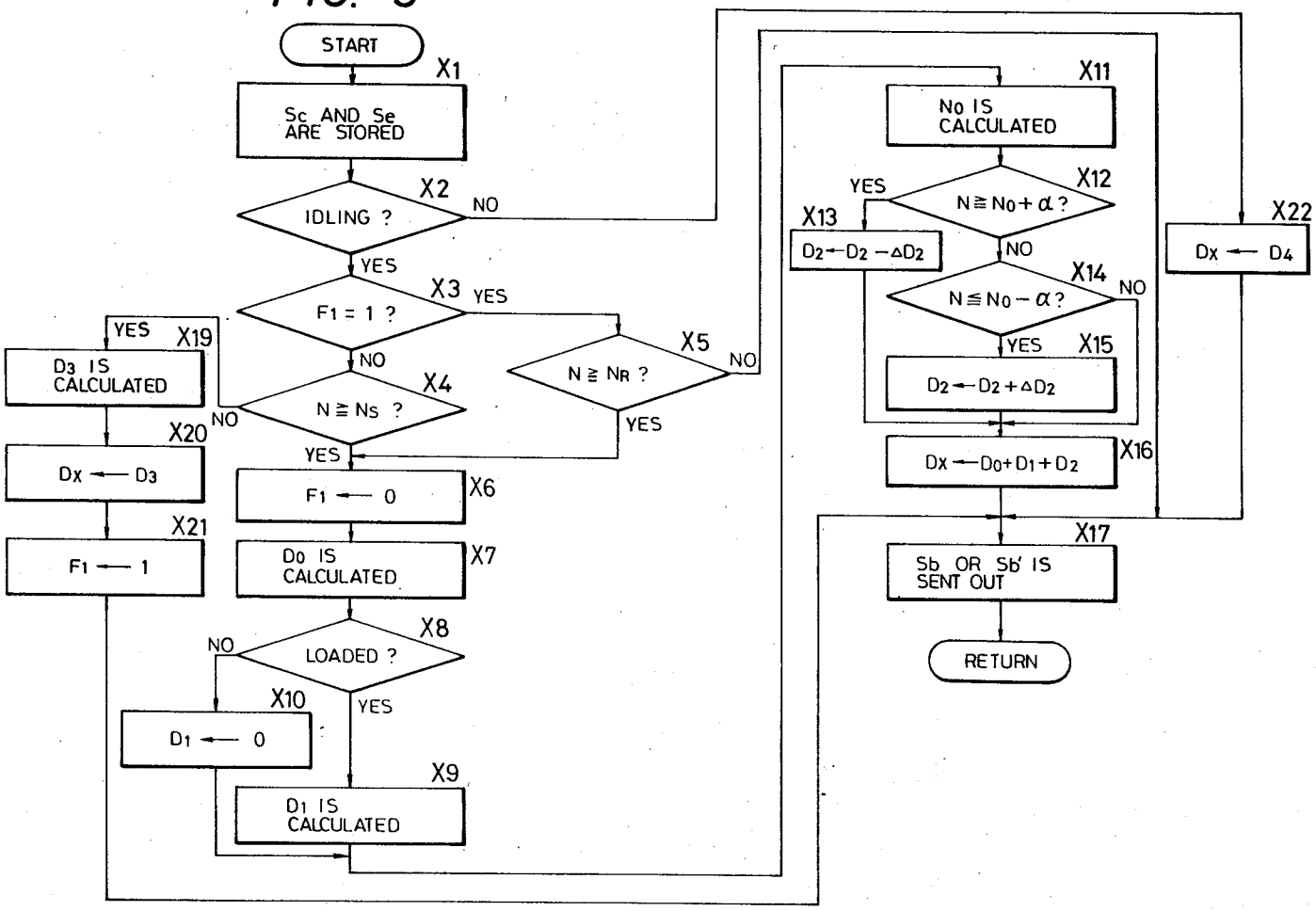
FIG. 3 is a flow chart used for explaining the operation of the embodiment shown in FIG. 2.
Figure 4:
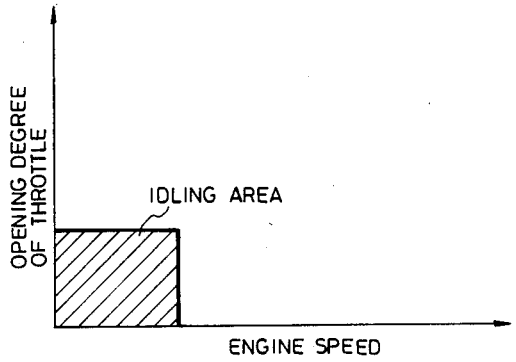
FIGS. 4, 5 and 6 are characteristic charts used for explaining the operation of the embodiment shown in FIG. 2.

According to the flow chart shown in FIG. 3, first, in a process X1, the detection output signals Sc and Se are stored. Then, in a decision X2, it is checked whether the engine 1 is in the idle operation or not on the strength of the actual engine speed N represented by the detection output signal Sc and the opening degree of the throttle valve 8 represented by the detection output signal Se. In this check, the idle operation may be defined with reference to an idling area indicated with hatchings on a characteristic chart shown in FIG. 4. If it is clarified that the engine 1 is in the idle operation, it is checked whether a flag $F_1$ is equal to 1 or not in a decision X3. If the flag $F_1$ is not equal to 1, it is checked whether the actual engine speed N is equal to or more than the first predetermined speed $N_S$ in a decision X4. The first predetermined speed $N_S$ is set to be lower enough than the target idling speed $N_O$, as indicated in characteristic charts shown in FIG. 5 and FIG. 6 and therefore the actual engine speed N may go down to be lower than the first predetermined speed $N_S$ only when the engine 1 is burdned with a relatively heavy appendant load such as an air conditioner.

When it is clarified that the actual engine speed N is equal to or more than the first predetermined speed $N_S$ in the decision X4, the step passes through a process X6, in which the flag $F_1$ is set to be zero in the case where the flag $F_1$ is equal to 1, to a process X7. In the process X7, a fundamental duration $D_0$ is calculated in accordance with the coolant temperature represented by the detection output signal Sf. After that, in a decision X8, it is checked whether the engine 1 is operating with an appendant load driven thereby or not. As a result of this check, if it is clarified that the engine 1 is operating with the appendant load driven thereby, a first supplemental duration $D_1$ is calculated on the strength of the detecting output signal Sg in a process X9, and then the step is advanced to a process X11. To the contrary, if the engine 1 is operating without any appendant load, the first supplemental duration $D_1$ is set to be zero in a process X10, and then the step is advanced to the process X11.

In the process X11, the target idling speed $N_O$ is determined in accordance with the operating condition of the engine 1 represented by the detection output signals Sd, Se, Sf and so on, and in a decision X12, it is checked whether the actual engine speed N is higher by $\alpha$ ($\alpha$ is a positive value) or more than the target idling speed $N_O$ or not. When the actual engine speed N is higher by $\alpha$ or more than the target idling speed $N_O$, a second supplemental duration $D_2$ is reduced by a predetermined unit duration $\Delta D_2$ in a process X13 and then the step is advanced to a process X16. On the other hand, when the actual engine speed N is not higher by $\alpha$ or more than the target idling speed $N_O$, it is checked whether the actual engine speed N is lower by $\alpha$ or more than the target idling speed $N_O$ or not in a decision X14. As a result of the check in the decision X14, if the actual engine speed N is not lower by $\alpha$ or more than the target idling speed $N_O$, the step is directly advanced to the process X16, and if the actual engine speed N is lower by $\alpha$ or more than the target idling speed $N_O$, the second supplemental duration $D_2$ is increased by the predetermined unit duration $\Delta D_2$ in a process X15. The operation in the steps from the decision X12 to the process X15 results in that the second supplemental duration $D_2$ is obtained through integrating operation for the predetermined unit durations $\Delta D_2$. Then, the step is advanced to the process X16.

In the process X16, a control duration $D_X$ is calculated by summing up the fundamental duration $D_0$, the first supplemental duration $D_1$ and the second supplemental duration $D_2$. After that, in a process X17, the control pulse signal Sb having its pulse duration corresponding to the control duration $D_X$ obtained in the process X16 is sent out to the electromagnetic control valve 11, and then the step returns to the process X1.

The electromagnetic control valve 11 supplied with the control pulse signal Sb operates to supply the combustion chamber 2 of the engine 1 with intake air mass flow corresponding to the pulse duration of the control pulse signal Sb.

With the circulating steps as aforementioned, the feedback idling speed control for causing the actual engine speed N to coincide with the target idling speed $N_O$ is performed. However, in such a case that the engine 1 is suddenly burdened with a relatively heavy appendant load in its idle operation, it is feared that the actual engine speed N of the engine 1 goes down to be lower than the first predetermined speed $N_S$ and then stops operating even though the feedback idling speed control is carried out. Accordingly, in this embodiment, in the case where the actual engine speed N of the engine 1 has gone down to be lower than the first predetermined speed $N_S$, the extra air supply control are performed for preventing the engine 1 from coming to a stop in its operation in such a manner as described below.

Turning now to the flow chart shown in FIG. 3, when it is clarified that the actual engine speed N is lower than the first predetermined speed $N_S$ in the decision X4, an extra control duration $D_3$ which corresponds to an extra intake air mass flow and is larger than the aforementioned control duration $D_X$ obtained by summing up the fundamental duration $D_0$, the first supplemental duration $D_1$ and the second supplemental duration $D_2$ in the process X16 is obtained in a process X19, and in a process 20, the extra control duration $D_3$ is transformed into the control duration $D_X$. Then, the flag $F_1$ is set to be 1 in a process X21, and the step is advanced directly to the process X17. In this case, the extra control pulse signal Sb' having its pulse duration corresponding to the extra control duration $D_3$ which is transformed into the control duration $D_X$ in the process X20 is sent out to the electromagnetic control valve 11, and then the step returns to the process X1.

With this extra control pulse signal Sb', the electromagnetic control valve 11 operates to increase the intake air passing through the bypass passage 10 to the combustion chamber 2 of the engine 1. That is, as indicated in the characteristic charts shown in FIGS. 5 and 6, intake air mass flow Af of augmented volume $V_1$ is supplied to the combustion chamber 2 of the engine 1, so that the actual engine speed N rises repidly to be higher than the first predetermined speed $N_S$.

Figure 5:
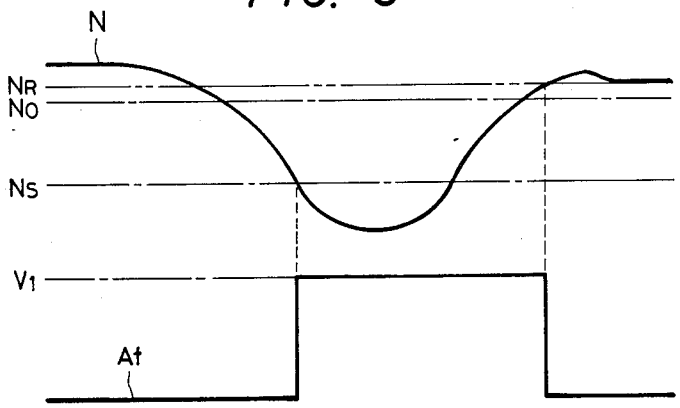

Then, when it is clarified that the flag $F_1$ has set to be 1 in the decision X3, it is checked whether the actual engine speed N is equal to or more than the second predetermined speed $N_R$ in a decision X5. The second predetermined speed $N_R$ is set to be higher than the first predetermined speed $N_S$, as indicated in the characteristic charts shown in FIGS. 5 and 6. In the case of FIG. 5, the second predetermined speed $N_R$ is set to be higher than not only the first predetermined speed $N_S$ but also the target idling speed $N_O$, and in the case of FIG. 6, the second predetermined speed NR is set to be higher enough than the first predetermined speed $N_S$ but slightly lower than the target idling speed $N_O$.

When it is clarified that the actual engine speed N is lower than the second predetermined speed $N_R$ in the decision X5, the step is advanced to the process X17. In the process X17, the extra control pulse signal Sb' is again sent out to the electromagnetic control valve 11, and then the step returns to the process X1. Consequently, in this case, the extra air supply control is continued.

To the contrary, when it is clarified that the actual engine speed N is equal to or higher than the second predetermined speed $N_R$ in the decision X5, the step is advanced to the process X6 and the flag $F_1$ is set to be zero in the process X6. Then, the step is further advanced from the step X7 to the step X17 in the same manner as aforementioned, so that the control pulse signal Sb is sent out to the electromagnetic control valve 11, in place of the extra control pulse signal Sb', in the process X17.

Furthermore, as a result of the check in the decision X2, if the engine 1 is not in the idle operation, the control duration $D_X$ is set to be a fixed duration $D_4$ in a process X22 and the step is advanced to the process X17. In this case, the control pulse signal Sb having the pulse duration corresponding to the fixed duration $D_4$ is sent out to the electromagnetic control valve 11 in the process X17, and then the step returns to the process X1. The electromagnetic control valve 11 is supplied with the control pulse signal Sb having the pulse duration corresponding to the fixed duration $D_4$ operates to supply the combustion chamber 2 of the engine 1 with constant intake air mass flow through the bypass passage 10.

As described above, in this embodiment, the extra air supply control by which the extra control pulse signal Sb' is supplied to the electromagnetic control valve 11 is commenced when the actual engine speed N has gone down to be lower than the first predetermined speed $N_S$ and terminated when the actual engine speed N has risen to attain the second predetermined speed $N_R$. During this extra air supply control, the intake air mass flow Af supplied through the bypass passage 10 to the combustion chamber 2 of the engine 1 is maintained to have the augmented volume $V_1$ and thereby the actual engine speed N of the engine 1 rises repidly to attain the second predetermined speed $N_R$ after having gone down to be lower than the first predetermined speed $N_S$, as indicated in the characteristic charts shown in FIGS. 5 and 6.

Especially, in the case where the second predetermined speed $N_R$ is set to be higher enough than the first predetermined speed $N_S$ but slightly lower than the target idling speed $N_O$, the engine 1 is surely prevented from making an undesirably sudden rise to be too high under the extra air supply control.

Figure 6:
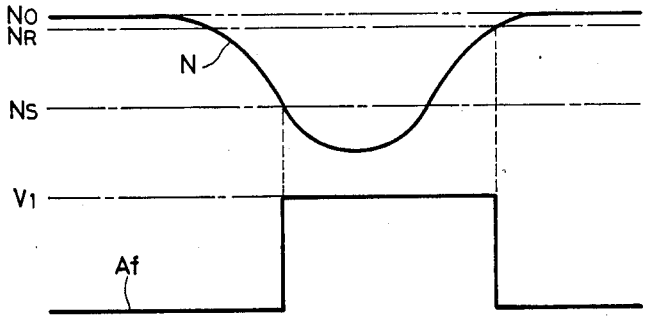

Further, in this embodiment, since the second predetermined speed $N_R$ is set to be close to the target idling speed $N_O$, as indicated in the characteristic charts shown in FIGS. 5 and 6, the actual engine speed N of the engine 1 can be easily caused to be kept at the target idling speed $N_O$ under the feedback idling speed control carried out after the extra air supply control, even if the feedback idling speed control is performed in such a manner as an integration control with a relatively small control gain. In addition, under a condition where the second predetermined speed $N_R$ is set to be higher enough than the first predetermined speed $N_S$ and close to the target idling speed $N_O$, the lowering of the actual engine speed N starts at speed close to the target idling speed $N_O$ in the case where, immediately after the termination of the extra air supplying control, the actual engine speed N of the engine 1 gose down again to be lower than the first predetermined speed $N_S$ so that another extra air supplying control is required. This results in the advantage that the engine 1 is surely prevented from making a stop in its operation in such a case also by another extra air supplying control.

Figure 7:
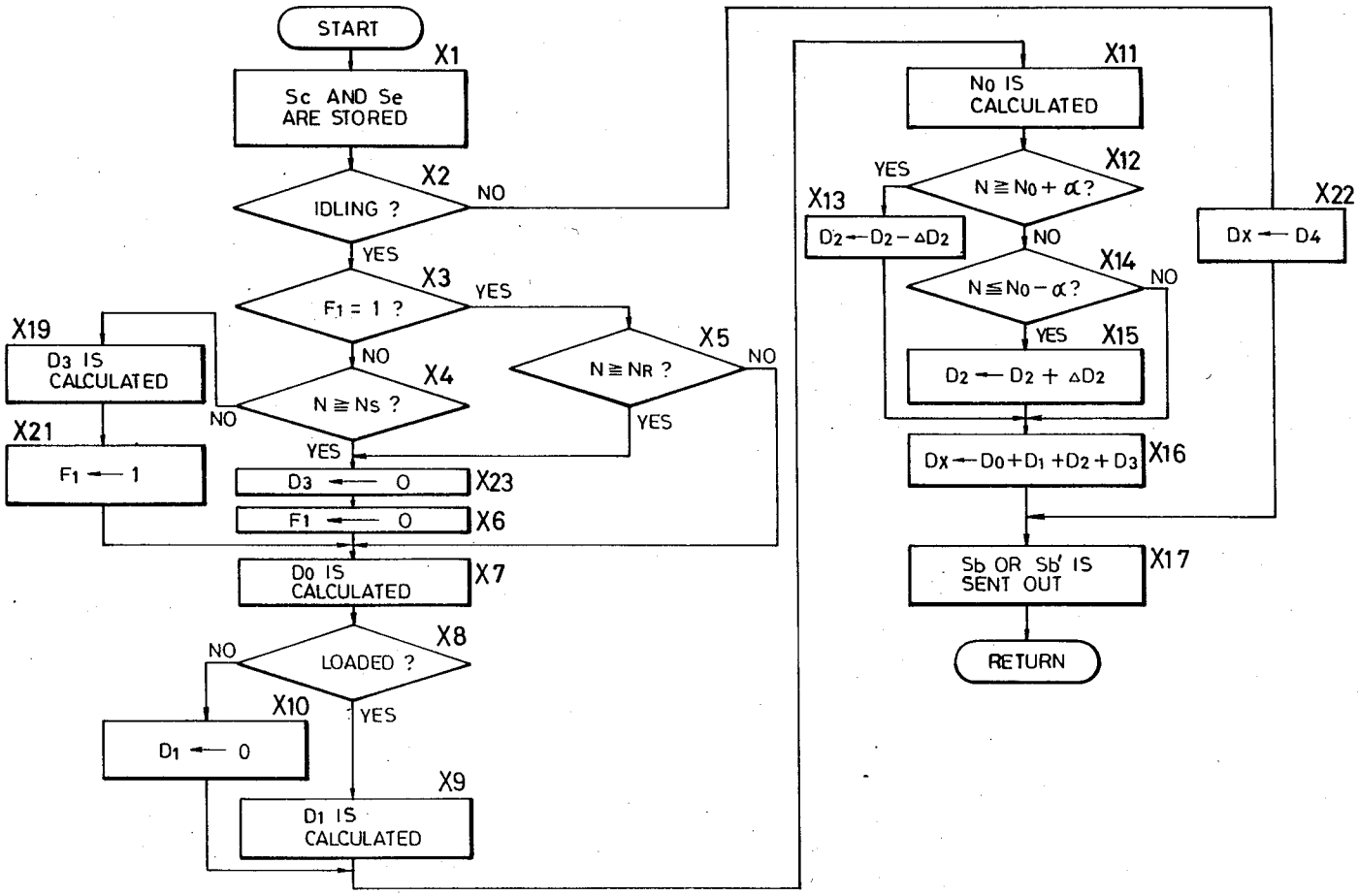
FIG. 7 is a flow chart used for explaining the operation of another embodiment of idling speed control system for an internal combustion engine according to the present invention.

FIG. 7 shows another example of an operation program of the microcomputer constituting the comprehensive controller 13 used for controlling the electromagnetic control valve 11, in the form of a flow chart. In the flow chart of FIG. 7, processes and decisions corresponding to those shown in the flow chart of FIG. 3 are marked with the same references and descriptions of steps advanced in the same manner as those on the flow chart of FIG. 3 will be omitted.

In this example, any process corresponding to the process X20 shown in the flow chart of FIG. 3 is not provided but a process X23 in which the extra control duration $D_3$ is set to be zero is provided between a decision X4 and a process X6.

Referring to the flow chart of FIG. 7, when it is clarified that the actual engine speed N is equal to or higher than the first predetermined speed $N_S$ in a decision X4, an extra control duration $D_3$ which is obtained in a process X19 as described later is set to be zero in the process X23, and then the step is advanced from the process X7 to the process X16 in the same manner as aforementioned with reference to the flow chart of FIG. 3. Accordingly, in this case, the control pulse signal Sb is sent out to the electromagnetic control valve 11 in the process X17 in the same manner as the case of the flow chart of FIG. 3, so that the feedback idling speed control is carried out.

On the other hand, when it is clarified that the actual engine speed N is lower than the first predetermined speed $N_S$ in the decision X4, the extra control duration $D_3$ which corresponds to an extra supplemental intake air mass flow is obtained in the process X19. After that, the flag $F_1$ is set to be 1 in a process X21, and the step is advanced to the process X7 so as to be further advanced from the process X7 to the process X16 in the same manner as mentioned above.

In the process X16, a control duration $D_X$ is calculated by summing up a fundamental duration $D_0$ calculated in the process X7, a first supplemental duration $D_1$ calculated in the process X9, a second supplemental duration $D_2$ obtained in the process X13 or X15 through integrating operation and the extra control duration $D_3$ obtained in the process X19. Then, in a process X17, the extra control pulse signal Sb' having its pulse duration corresponding to the control duration $D_X$ obtained by summing up the fundamental duration $D_0$, the first supplemental duration $D_1$, the second supplemental duration $D_2$ and the extra control duration $D_3$ in the process X16 is sent out to the electromagnetic control valve 11, and then the step returns to the process X1.

With this extra control pulse signal Sb', the electromagnetic control valve 11 operates to increase the intake air passing through the bypass passage 10 to the combustion chamber 2 of the engine 1, and the extra air supply control is carried out.

Then, when it is clarified that the actual engine speed N is lower than the second predetermined speed $N_R$ in the decision X5, the step is advanced to the process X6 so as to be further advanced from the process X6 to the process X17 in the same manner as mentioned above. Therefore, the extra air supply control is continued.

To the contrary, when it is clarified that the actual engine speed N is equal to or higher than the second predetermined speed $N_R$ in the decision X5, the step is advanced to the process X23 and the extra control duration $D_3$ is set to be zero in the process X23. Then, the step is further advanced from the process X7 to the process X17 in the same manner as aforementioned, so that the control pulse signal Sb is sent out to the electromagnetic control valve 11, in place of the extra control pulse signal Sb', in the process X17, and the extra air supply control is terminated.

As described above, in the case of this example, the extra control pulse signal Sb' is formed to have its pulse duration corresponding to the control duration $D_X$ obtained by summing up the fundamental duration $D_0$. the first supplemental duration $D_1$, the second supplemental duration $D_2$ and the extra control duration $D_3$, and therefore the feedback idling speed control is substantially continued during a period in which the extra air supply control is carried out.

Although the idling speed of the engine 1 is controlled with adjustment of intake air mass flow supplied through the bypass passage 10 to the combustion chamber 2 of the engine 1 by the electromagnetic control valve 11 in the above described embodiments, it is also possible to have such an arrangement as to control the idling speed of the engine 1 by adjusting intake air mass flow supplied through the inlet passage 5 to the combustion chamber 2 by the throttle valve 8.

What is claimed is:

1. An idling speed control system for an internal combustion engine comprising;

engine speed sensing means for detecting speed of the engine, target idling speed determining means for setting a target idling speed, intake air mass flow determining means for obtaining a difference between an actual idling speed of the engine detected by said engine speed sensing means and said target idling speed set by said target idling speed determining means and producing a control signal for determining intake air mass flow supplied to a combustion chamber of the engine on the strength of the difference obtained, intake air mass flow adjusting means for adjusting intake air mass flow supplied actually to the combustion chamber of the engine in response to said control signal, and extra intake air supplying means for causing said intake air mass flow adjusting means to start supplying the combustion chamber of the engine with extra intake air mass flow determined apart from the intake air mass flow determined in response to said control signal when the actual idling speed of the engine has gone down to be lower than a first predetermined speed and then to cause said intake air mass flow adjusting means to cease supplying the combustion chamber of the engine with the extra intake air mass flow when the actual idling speed of the engine has risen to attain a second predetermined speed higher than said first predetermined speed.

2. An idling speed control system according to claim 1, wherein said extra intake air supplying means comprises extra intake air mass flow determining means for commencing to supply said intake air mass flow adjusting means with an additional control signal for determining the extra intake air mass flow when the actual idling speed of the engine has gone down to be lower than said first predetermined speed and for terminating to supply said intake air mass flow adjusting means with the additional control signal when the actual idling speed of the engine has risen to attain said second predetermined speed, and said intake air mass flow determining means comprises operational means operative to conduct integrating operation.

3. An idling speed control system according to claim 2, wherein said extra intake air mass flow determining means comprises means for setting said first predetermined speed lower than said target idling speed, means for setting said second predetermined speed, first comparing means for comparing the actual idling speed of the engine with said first predetermined speed and producing an extra signal when the actual idling speed of the engine has gone to be lower than said first predetermined speed, second comparing means for comparing the actual idling speed of the engine with said second predetermined speed during a period in which said first comparing means produces said extra signal, and means for receiving said extra signal and supplying said intake air mass flow adjusting means with said additional control signal in response to said extra signal.

4. An idling speed control system according to claim 3, wherein said second predetermined speed is set to be lower than said target idling speed.

5. An idling speed control system according to claim 4, wherein said second predetermined speed is set to be close to said target idling speed.

6. An idling speed control system according to claim 3, wherein said second predetermined speed is set to be close to said target idling speed.

7. An idling speed control system according to claim 6, wherein said second predetermined speed is set to be higher than said target idling speed.

8. An idling speed control system according to claim 2, wherein said intake air mass flow adjusting means comprises a bypass passage provided to an inlet passage of the engine to detour a throttle valve disposed in the inlet passage and control valve means provided on said bypass passage for adjusting intake air mass flow in said bypass passage.

9. An idling speed control system according to claim 8, wherein said control valve means comprises an electromagnetic control valve operative to adjust the intake air mass flow in said bypass passage in response to its opening duty ratio.

10. An idling speed control system according to claim 9, wherein said extra intake air mass flow determining means comprises means for setting said first predetermined speed lower than said target idling speed, means for setting said second predetermined speed, first comparing means for comparing the actual idling speed of the engine with said first predetermined speed and producing an extra signal when the actual idling speed of the engine has gone to be lower than said first predetermined speed, second comparing means for comparing the actual idling speed of the engine with said second predetermined speed during a period in which said first comparing means produces said extra signal, and means for receiving said extra signal and supplying said electromagnetic control valve with said additional control signal in response to said extra signal.

11. An idling speed control system according to claim 10, wherein said second predetermined speed is set to be lower than said target idling speed.

12. An idling speed control system according to claim 11, wherein said second predetermined speed is set to be close to said target idling speed.

13. An idling speed control system according to claim 10, wherein said second predetermined speed is set to be close to said target idling speed.

14. An idling speed control system according to claim 13, wherein said second predetermined speed is set to be higher than said target idling speed.

* * * * *